US006983802B2

(12) United States Patent
Bolin et al.

(10) Patent No.: US 6,983,802 B2
(45) Date of Patent: Jan. 10, 2006

(54) METHODS AND APPARATUS FOR ENHANCING PRODUCTION FROM A HYDROCARBONS-PRODUCING WELL

(75) Inventors: William D. Bolin, Spring, TX (US); Patrick L. Grizzle, Woodlands, TX (US); Christian M. Snyder, Dallas, TX (US)

(73) Assignee: Kerr-McGee Oil & Gas Corporation, Oklahoma City, OK (US)

( * ) Notice: Subject to any disclaimer, the term of this patent is extended or adjusted under 35 U.S.C. 154(b) by 88 days.

(21) Appl. No.: 10/758,991

(22) Filed: Jan. 20, 2004

(65) Prior Publication Data

US 2005/0155768 A1 Jul. 21, 2005

(51) Int. Cl.
*E21B 43/16* (2006.01)

(52) U.S. Cl. ..... 166/369; 166/68; 166/105; 166/310

(58) Field of Classification Search ..... 166/65.1, 166/105, 68, 369, 304, 310
See application file for complete search history.

(56) References Cited

U.S. PATENT DOCUMENTS 1,716,709 A * 6/1929 Smith ..... 417/431
3,380,531 A * 4/1968 McAuliffe et al. ..... 166/371
4,605,069 A * 8/1986 McClaflin et al. ..... 166/310
4,643,258 A * 2/1987 Kime ..... 166/369
4,749,034 A * 6/1988 Vandevier et al. ..... 166/105
4,832,127 A * 5/1989 Thomas et al. ..... 166/369
4,896,725 A * 1/1990 Parker et al. ..... 166/267
5,159,977 A * 11/1992 Zabaras ..... 166/105
5,348,094 A * 9/1994 Cholet et al. ..... 166/371
5,845,709 A * 12/1998 Mack et al. ..... 166/302
6,533,039 B2 * 3/2003 Rivas et al. ..... 166/369
6,702,028 B1 * 3/2004 Heggholmen ..... 166/372
2002/0153141 A1 * 10/2002 Hartman et al. ..... 166/302

* cited by examiner

*Primary Examiner*—Hoang Dang

(57) ABSTRACT

Methods and apparatus for producing hydrocarbons from a well, and especially for producing gas from low pressure gas wells containing water, are disclosed. An electrical submersible pump is attached to and in fluid communication with the bottom end of a string of pipe joints or tubing extending in the well bore from the surface to below the water-containing gas interval, a further string of pipe joints or tubing having one or more openings therein at the bottom end thereof extends from the surface to below the water-containing gas interval, and water supplied from the surface via the further string of pipe joints or tubing along with water from the water-containing gas interval is constantly pumped by the electrical submersible pump at a rate sufficient to prevent the pump from overheating and failing and to prevent production-limiting water build-up in the well bore.

4 Claims, 4 Drawing Sheets

METHODS AND APPARATUS FOR ENHANCING PRODUCTION FROM A HYDROCARBONS-PRODUCING WELL

BACKGROUND OF THE INVENTION

1. Field of the Invention

The present invention relates to methods and apparatus for enhancing the production of hydrocarbons from a well, and in a particular, preferred context of use to methods and apparatus for producing low pressure gas wells containing water.

2. Description of the Prior Art

The usefulness of the present invention is probably best illustrated with reference to this preferred, non-limiting context of use. In this regard, gas producing formations often experience significant water encroachment as the gas is produced thereby reducing the gas formation pressure. The water builds up in the well bore penetrating the formation and eventually prevents the low pressure gas remaining from being produced. In order to return the gas formations containing low pressure gas and water to production, the water is artificially lifted to the surface thereby allowing the gas to be produced. The low formation pressure in most of the water-containing gas formations does not allow the use of artificial gas lift and plunger lift. The use of conventional rod pumping units is generally difficult due to the well depths and amounts of water that must be lifted. Mechanical and corrosion problems contribute to making the use of rod pumping units difficult.

A preferred form of artificial lift that has been used for low pressure water-containing gas wells utilizes an electrical submersible pump. A significant number of electrical submersible pumps are presently being used for producing low pressure gas wells containing water. However, due to the continuing decrease in water volumes in some of the gas fields utilizing electrical submersible pumps, the pumped water has fallen below the electrical submersible pump operating design. As a result, the electrical submersible pumps have often failed.

Thus, there are continuing needs for methods of reducing failures of electrical submersible water pumps in wells where the amounts of water produced by the wells have become substantially diminished.

SUMMARY OF THE INVENTION

The present invention provides methods and apparatus for producing low pressure gas wells containing water utilizing electrical submersible pumps which meet the needs described above and overcome the deficiencies of the prior art. Essentially the same methods and apparatus can, however, be adapted to address a number of other production-limiting issues in hydrocarbon-producing wells generally, including for example the formation of gas hydrates, high viscosities in crude oil production and paraffin buildup.

Accordingly, from a broader perspective the present invention provides methods and apparatus for enhancing production from a hydrocarbons-producing well, characterized in that an electrical submersible pump is attached to the bottom end of a string of pipe joints or tubing and is placed in the well bore (by means of such string) below a hydrocarbons-producing interval. Thereafter, a liquid comprising crude oil or water is flowed from the surface through a string of pipe joints or tubing to a point below the hydrocarbons-producing interval, whereupon the liquid exits the string and is joined with a liquid comprising oil, water or both from the hydrocarbons-producing interval. The combined liquids are then pumped to the surface by the electrical submersible pump.

A method of this invention for producing a water-containing gas interval in a subterranean formation penetrated by a well bore uses water as the liquid that is supplied from the surface, whereby with low gas formation pressures sufficient water is continuously made available to the pump to prevent pump overheating and subsequent failure leading to water build-up in the well bore that reduces or prevents gas production from the water-containing gas interval, and/or whereby water containing chemical treatments for the prevention of gas hydrates, corrosion, scale and the like may be supplied. A method for producing hydrocarbons including a high viscosity crude oil component would use a lighter, less viscous crude oil as the liquid supplied from the surface to improve the recovery of the formation crude oil, while paraffin buildup can be addressed by the method of the invention by using heated oil or heated water.

An apparatus of this invention for producing hydrocarbons from an interval in a subterranean formation penetrated by a well bore includes the following components. An electrical submersible pump is attached to the bottom end of a string of pipe joints or tubing extending in the well bore from the surface to below the hydrocarbons-producing interval. A surface source of a liquid comprising crude oil or water is connected to a string of pipe joints or tubing at the surface for supplying and controlling a flow of the liquid through the string into the well bore to below the interval, so that the liquid is combined with a liquid comprised of oil, water or both from the interval and the combination is pumped by the electrical submersible pump to the surface and to a storage or disposal location thereon.

The objects, features and advantages of the present invention will be readily apparent to those skilled in the art upon a reading of the description of preferred embodiments which follows.

DESCRIPTION OF PREFERRED EMBODIMENTS

Figure 1:
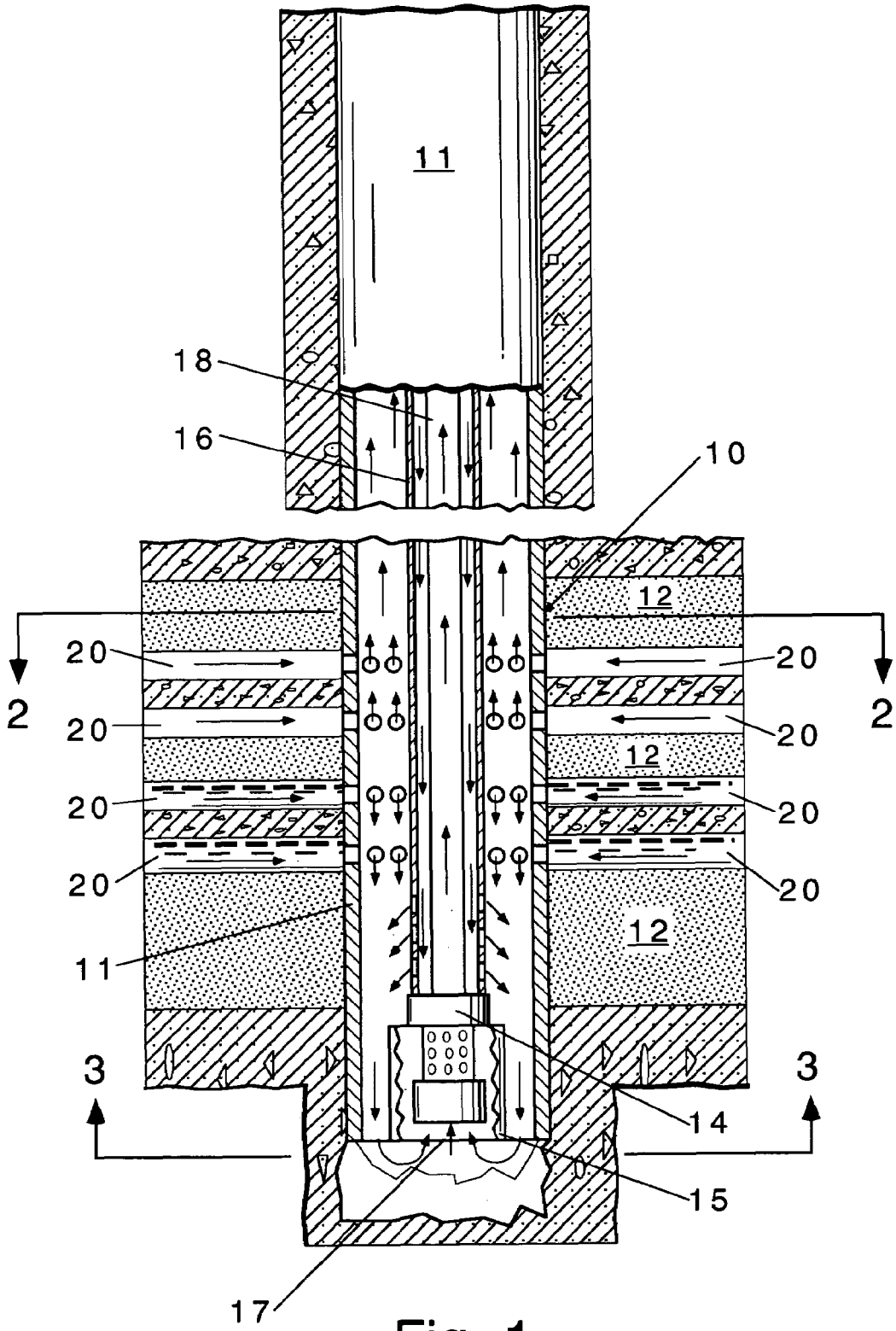
FIG. 1 is a side, partially sectional view of a cased and perforated well bore penetrating a low pressure water-containing gas interval including an electrical submersible pump attached to the bottom end of a string of pipe joints or tubing having one or more openings therein at a bottom end for providing water from the surface, and to a further string of pipe joints or tubing for conveying water via the pump to the surface.

The present invention provides methods of producing low pressure water-containing gas intervals in subterranean formations penetrated by well bores whereby gas production-limiting water level build-up or loss of water level in the well bores does not occur. The methods are basically comprised of the following steps. An electrical submersible pump attached to the bottom end of a string of pipe joints or tubing is placed in the well bore below the water-containing gas interval. The same string of pipe joints or tubing extends to the surface whereby water pumped by the electrical submersible pump is conducted to a storage or disposal location. A further string of pipe joints or tubing is placed in the well bore having one or more openings therein at the bottom end thereof, which string also extends below the water-containing gas interval. Water from the surface is flowed through the further string of pipe joints or tubing so that the water exits the string of pipe joints or tubing and is pumped by the electrical submersible pump along with water from the water-containing gas interval to the surface, with the flow of water from the surface being adjusted so that the electrical submersible pump constantly pumps sufficient water to prevent pump overheating due to the lack of water and while the water level in said well bore is maintained below the water-containing gas interval.

The well bore preferably includes casing therein and is perforated in the water-containing gas interval. The respective conduit strings for removing water to the surface and for supplying needed additional water can be strings of pipe joints or tubing, for example, coil tubing, small screw tubing or the like. The second, fluid return string of pipe joints or tubing (item 18 in the drawings) conventionally will be sized to accommodate a greater flow of liquid (e.g., water) than the first, surface fluid supply string (item 16) of pipe joints or tubing, as liquid from the formation will be added in the second string.

Figure 2:
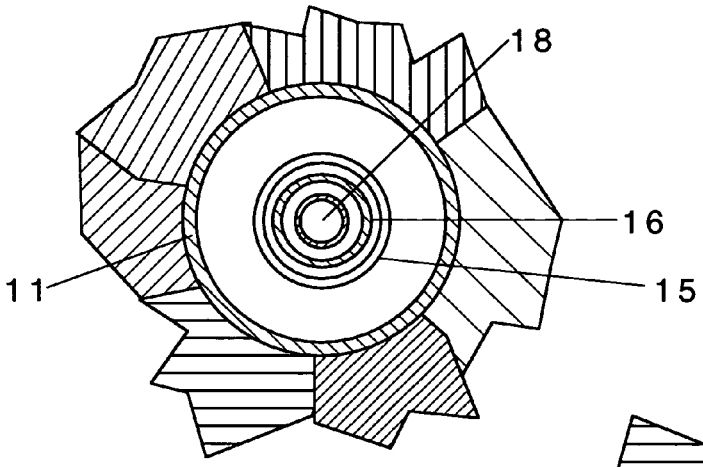
FIG. 2 is a cross-sectional view taken along line 2—2 of FIG. 1.
Figure 3:
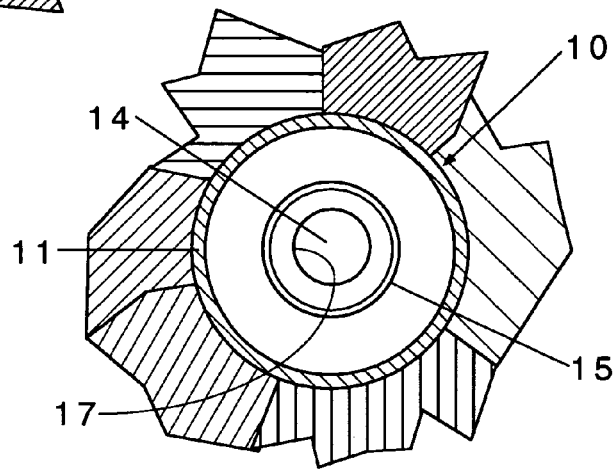
FIG. 3 is a cross-sectional view taken along line 3—3 of FIG. 1.

Referring now to the drawings and particularly FIGS. 1 through 3, a first preferred embodiment of the apparatus of the invention is illustrated. In FIG. 1 particularly, a bottom portion of a cased and perforated well bore 10 penetrating a low pressure water-containing gas interval 12 is illustrated. Disposed within the casing 11 that contains perforations 20 is an electrical submersible pump 14 attached to and in fluid communication with the bottom end of a second, fluid return string of pipe joints or tubing 18, preferably coil tubing. The electrical submersible pump 14 is connected to a source of electrical power at the surface by a power cable (not shown). As shown in FIGS. 1 through 3, the electrical submersible pump 14 includes a shroud 15 having an opening 17 at the bottom end thereof through which water from the interior of the well bore 10 flows and is pumped by the pump 14 into the second string of pipe joints or tubing 18. The string of pipe joints or tubing 18 extends from the electrical submersible pump 14 to the surface (not shown). The electrical submersible pump 14 is positioned in the well bore 10 below the water-containing gas interval 12.

A first string of pipe joints or tubing 16 having one or more openings therein at the bottom end thereof is also disposed in the well bore for carrying fluid from the surface into the well bore below the interval 12. In the arrangement shown in FIGS. 1 through 3 of the drawings, the first string of pipe joints or tubing 16 is preferably a string of production tubing and the second string of pipe joints or tubing 18 is preferably coil tubing disposed within the first string of pipe joints or tubing 16. As shown in FIG. 1, the bottom end of the first string of pipe joints or tubing 16 can be attached to the electrical submersible pump 14 to thereby maintain the second string of pipe joints or tubing 18 in a central position within the string of pipe joints or tubing 16.

Figure 5:
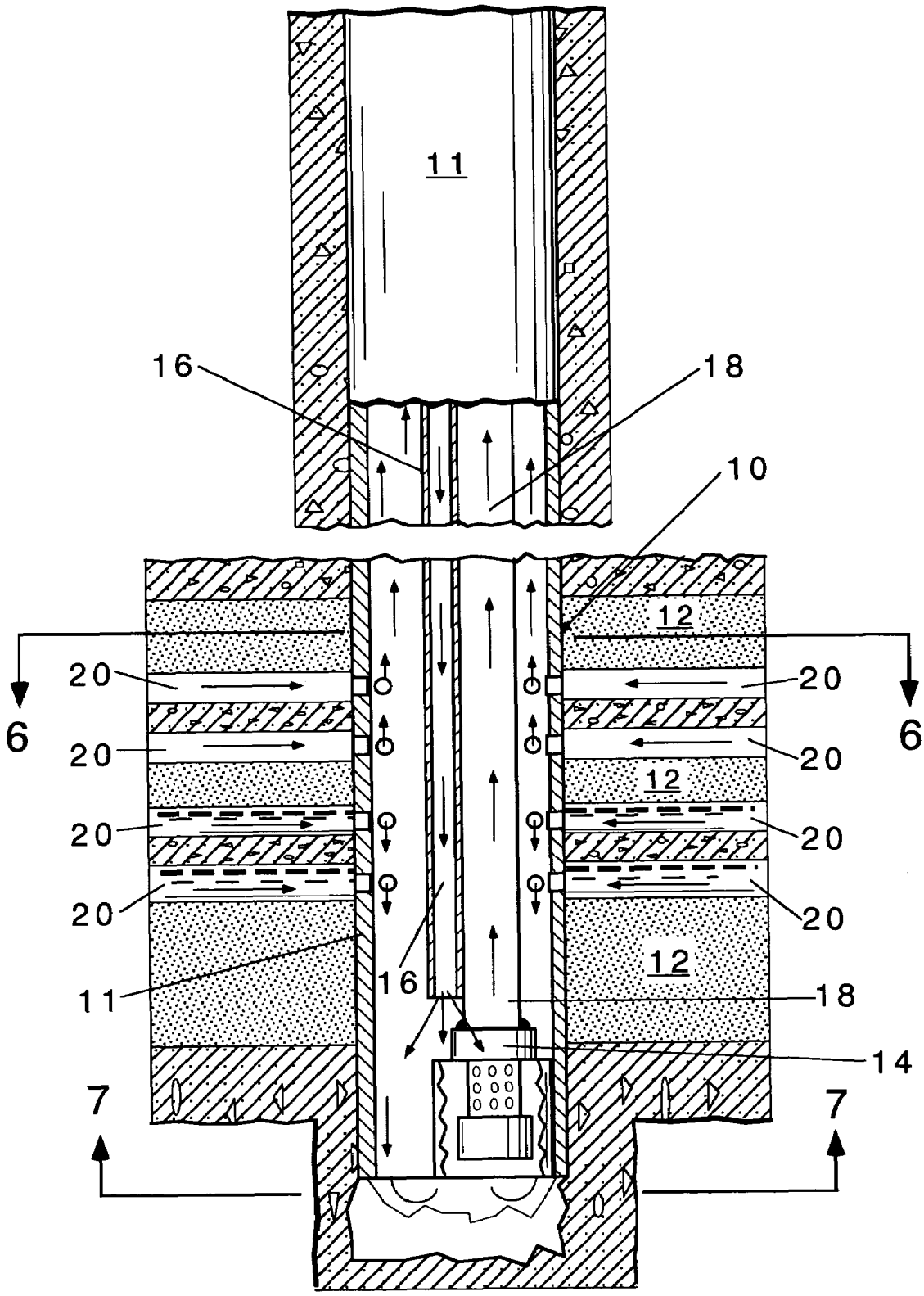
FIG. 5 is a side, partially sectional view of the cased and perforated well bore penetrating a low pressure water-containing gas interval shown in FIG. 1, but with the first string of pipe joints or tubing 16 positioned outside of the second string of pipe joints or tubing 18.
Figure 6:
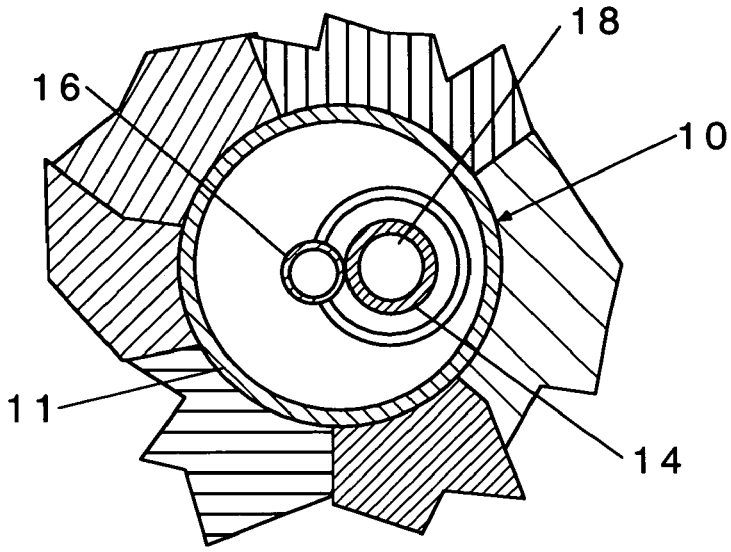
FIG. 6 is a cross-sectional view taken along line 6—6 of FIG. 5.
Figure 7:
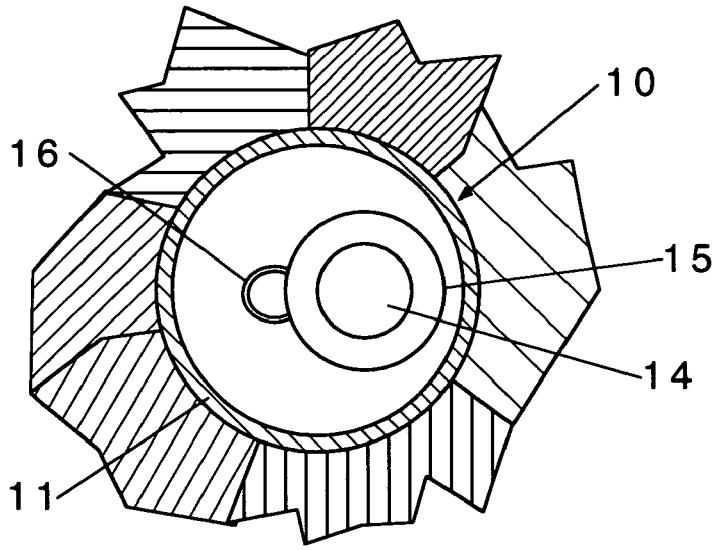
FIG. 7 is a cross-sectional view taken along line 7—7 of FIG. 5.

In a second or alternate preferred embodiment of the apparatus of the present invention as shown in FIGS. 5 through 7, the first string of pipe joints or tubing 16 can be located outside the second string of pipe joints or tubing 18 and can be unattached to the electrical submersible pump 14. In the arrangement shown in FIGS. 5 through 7, the second string of pipe joints or tubing 18, preferably tubing, is attached to the electrical submersible pump 14 as shown. The first string of pipe joints or tubing 16, preferably pipe joints, is open ended and not attached to the pump 14 (but is preferably banded to the second string 18 and to the power cable (not shown)). The electrical submersible pump 14 and the lower open end of the first string of pipe joints or tubing 16 are positioned below the water-containing gas interval. As will be understood by those skilled in the art, the strings of pipe joints or tubing 16 and 18 can be formed of pipe strings, tubing or other conduits formed of different materials.

As mentioned above, the casing 10 and the water-containing gas interval 12 contain a plurality of perforations 20 through which gas and water flow into the well bore. The water flows downwardly in the well bore as shown by the arrows into the bottom portion of the well bore and the gas flows upwardly in the well bore as shown by the arrows to the surface.

In operation, water from the surface is flowed through the first string of pipe joints or tubing 16 so that the water exits the string of pipe joints or tubing 16 below the water-containing gas interval 12. The water flowed from the surface through the first, surface fluid supply string of pipe joints or tubing 16 is pumped by the electrical submersible pump 14 along with water that enters the well bore from the water-containing gas interval 12 to the surface. Thus, the electrical submersible pump 14 constantly pumps sufficient water to prevent pump overheating due to the lack of water and to prevent water build-up in the well bore that reduces or prevents gas production.

Figure 4:
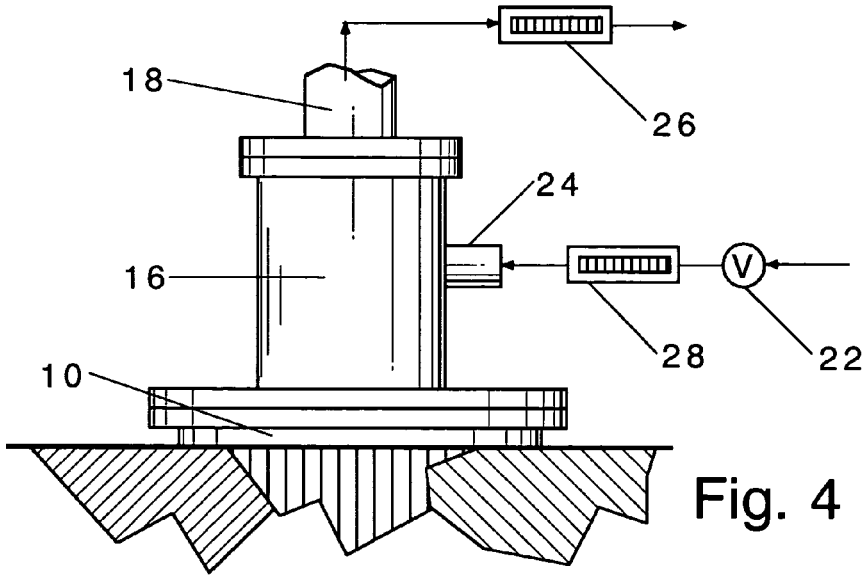
FIG. 4 is a side view of a portion of the casing 11 extending above the surface and the first and second strings of pipe joints or tubing 16 and 18 extending therefrom, the first string 16 (corresponding to the string supplying water from the surface) having a flow meter 28 disposed therein in association with a valve 22 and the second string 18 (for conveying water to the surface) having a flow meter 26 disposed therein.

The flow rate of water supplied through the first string of pipe joints or tubing 16 is controlled so that the water pumped through the second, fluid return string of pipe joints or tubing 18 by the electrical submersible pump 14 is generally maintained at a rate whereby the water level in the well bore is below the water-containing gas interval 12. As shown in FIG. 4, this control can be accomplished manually by opening or closing a valve 22 in a water line 24 on the surface connected to the first string of pipe joints or tubing 16 based on the reading of a flow meter 26 disposed in the second, fluid return string of pipe joints or tubing 18 at the surface. A second flow meter 28 can be disposed in the line 24. As is well understood by those skilled in the art, the flow of water through the first, surface fluid supply string of pipe joints or tubing 16 can optionally be controlled automatically by a control valve and flow controller (not shown) in combination.

Thus, the apparatus for producing a low pressure water-containing gas interval in a subterranean formation penetrated by a well bore may be generally summarized as follows. An electrical submersible pump is attached to and in fluid communication with the bottom end of a string of pipe joints or tubing extending in the well bore from the surface to below the water-containing gas interval, whereby water can be pumped to the surface from the well bore by means of such string. A further string of pipe joints or tubing having one or more openings therein at the bottom end thereof also extends in the well bore from the surface to below the water-containing gas interval, and is used to supply water from the surface into the well bore. Means are provided at the surface in association with these strings of pipe joints or tubing for supplying and controlling the flow of water from the surface to below the water-containing gas interval. This flow is controlled so that the supplied water along with water from the water-containing gas interval is constantly pumped by the electrical submersible pump to the surface and to a storage or disposal location thereon at a sufficient rate to prevent the electrical submersible pump from overheating due to lack of water and to prevent water build-up in the well bore that reduces or prevents gas production.

The methods and apparatus of this invention can also be used to lift iron-sulfide complex solids to the surface formed as a result of the production of sour gas ($H_2S$) from the water-containing gas interval. The iron-sulfide complex solids that normally accumulate in the well bore are lifted to the surface as a result of the high water rates made possible by the present invention.

The methods and apparatus of this invention can also be used to inject aqueous or hydrocarbon liquids containing various chemical treatment additives into the well bore such as chemicals for inhibiting one or more of corrosion, scale or the formation of gas hydrates. Also, light oil such as a less viscous crude oil can be circulated through the well bore to cut viscous crude oil therein and/or heated water or heated oil can be circulated to prevent paraffin build-up.

A preferred method of this invention for enhancing production from a hydrocarbons-producing interval in a subterranean formation penetrated by a well bore comprises the steps of:

(a) placing an electrical submersible pump attached to and in fluid communication with the bottom end of a string of pipe joints or tubing in said well bore below said interval; and (b) flowing a liquid comprising crude oil or water from the surface through a string of pipe joints or tubing in said well bore to below said interval whereby the liquid exits said string and combines with a liquid comprising oil, water or both produced from said interval; and (c) pumping the combined liquids to the surface through said string of pipe joints or tubing attached to said electrical submersible pump by means of said electrical submersible pump.

A preferred method of this invention for producing a low pressure water-containing gas interval in a subterranean formation penetrated by a well bore whereby production-limiting water level build-up or loss of water level in the well bore does not occur, comprises the steps of: (a) placing an electrical submersible pump attached to and in fluid communication with the bottom end of a string of pipe joints or tubing in the well bore below the water-containing gas interval, the string of pipe joints or tubing extending to the surface whereby water pumped by the electrical submersible pump is conducted to a storage or disposal location; (b) placing a further string of pipe joints or tubing in the well bore having one or more openings therein at the bottom end thereof, the bottom end of this string of pipe joints or tubing extending below the water-containing gas interval; and (c) flowing sufficient water from the surface through the further string of pipe joints or tubing so that the water exits the string of pipe joints or tubing and is pumped by the electrical submersible pump along with water from the water-containing gas interval at a rate whereby the electrical submersible pump does not overheat due to a lack of water and whereby water build-up in the well bore that reduces or prevents gas production from the water-containing gas interval does not occur.

A preferred apparatus of this invention for producing a low pressure water-containing gas interval in a subterranean formation penetrated by a well bore comprises:

an electrical submersible pump attached to and in fluid communication with the bottom end of a string of pipe joints or tubing extending in the well bore from the surface to below the water-containing gas interval;

a further string of pipe joints or tubing having one or more openings therein at the bottom end thereof extending in the well bore from the surface to below the water-containing gas interval;

means associated with the strings of pipe joints or tubing at the surface for supplying and controlling a flow of water from the surface to below the water-containing gas interval so that the supplied water along with water from the water-containing gas interval is constantly pumped by the electrical submersible pump to the surface and to a storage or disposal location thereon at a rate sufficient to prevent the electrical submersible pump from overheating due to a lack of water and to prevent water build-up in the well bore that reduces or prevents gas production.

Thus, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A method of producing a low pressure water-containing gas interval in a subterranean formation penetrated by a well bore whereby production-limiting water level build-up or loss of water level in the well bore does not occur, comprising the steps of:

(a) placing an electrical submersible pump attached to and in fluid communication with the bottom end of a string of pipe joints or tubing in said well bore below said water-containing gas interval, said string of pipe joints or tubing extending to the surface whereby water pumped by said electrical submersible pump is conducted to a storage or disposal location;

(b) placing a further string of pipe joints or tubing in said well bore having one or more openings therein at the bottom end thereof, the bottom end of said string of tubing extending below said water-containing gas interval; and (c) flowing water from the surface through said further string of pipe joints or tubing so that said water exits said string of pipe joints or tubing and is pumped by said electrical submersible pump along with water from said water-containing gas interval to the surface at a rate sufficient to prevent pump overheating due to a lack of water and to prevent water build-up in said well bore that reduces or prevents gas production from said water-containing gas interval.

2. The method of claim 1 wherein the flow rate of said water supplied from the surface is controlled so that water is pumped from the well bore by said electrical submersible pump at a rate whereby the water level in said well bore is kept below said water-containing gas interval.

3. The method of claim 1 wherein the flow rate of said water supplied from the surface is controlled at the surface based on the flow rate of water pumped from the well bore to the surface.

4. The method of claim 1 wherein chemical treatment additives are incorporated in the water supplied from the surface for inhibiting one or more of corrosion, scale or gas hydrate formation.

* * * * *